US008241093B2

(12) United States Patent
Piguet et al.

(10) Patent No.: US 8,241,093 B2
(45) Date of Patent: Aug. 14, 2012

(54) PRECISION GUIDING DEVICE IN A MACHINE FOR MACHINING CYLINDRICAL COMPONENTS

(75) Inventors: Pierre-Louis Piguet, Les Geneveys-sur-Coffrane (CH); Pierre Pahud, Porrentruy (CH)

(73) Assignee: Rollomatic SA, Le Landeron (CH)

( * ) Notice: Subject to any disclaimer, the term of this patent is extended or adjusted under 35 U.S.C. 154(b) by 368 days.

(21) Appl. No.: 12/733,354

(22) PCT Filed: Aug. 28, 2008

(86) PCT No.: PCT/IB2008/053471

§ 371 (c)(1),
(2), (4) Date: Feb. 24, 2010

(87) PCT Pub. No.: WO2009/027939

PCT Pub. Date: Mar. 5, 2009

(65) Prior Publication Data

US 2010/0248589 A1 Sep. 30, 2010

(30) Foreign Application Priority Data

Aug. 31, 2007 (EP) ..... 07115420

(51) Int. Cl.
*B24B 51/00* (2006.01)

(52) U.S. Cl. ..... 451/11; 451/381; 451/365; 269/247; 269/243

(58) Field of Classification Search ..... 451/11, 451/385, 365; 269/247, 243, 43, 45, 71, 269/291, 279, 280; 29/281.1; 248/65, 74.1, 248/74.4, 228.5
See application file for complete search history.

(56) References Cited

U.S. PATENT DOCUMENTS

| | | | | | |
|---|---|---|---|---|---|
| 1,055,757 | A | * | 3/1913 | King | 81/185.1 |
| 1,112,192 | A | * | 9/1914 | Callan | 269/221 |
| 2,405,288 | A | * | 8/1946 | Butt | 269/128 |
| 2,832,122 | A | * | 4/1958 | Espari et al. | 269/243 |
| 3,097,843 | A | * | 7/1963 | Morrow | 269/40 |
| 3,414,950 | A | * | 12/1968 | Phariss | 24/280 |
| 3,591,988 | A | | 7/1971 | Price | |
| 3,596,898 | A | * | 8/1971 | Hilburn | 269/243 |
| 4,750,662 | A | * | 6/1988 | Kagimoto | 228/44.5 |
| 4,865,300 | A | * | 9/1989 | Borzym | 269/13 |
| 5,165,160 | A | * | 11/1992 | Poncelet | 29/464 |
| 5,400,674 | A | * | 3/1995 | Arnone et al. | 74/490.13 |
| 5,727,778 | A | * | 3/1998 | Nodar | 269/43 |
| 5,770,006 | A | * | 6/1998 | Andrew et al. | 156/499 |
| 2010/0148015 | A1 | * | 6/2010 | Matsuno et al. | 248/65 |

FOREIGN PATENT DOCUMENTS

| | | | |
|---|---|---|---|
| DE | 8915435 | U1 | 6/1990 |
| FR | 2684035 | A | 5/1993 |
| GB | 363781 | A | 12/1931 |

* cited by examiner

*Primary Examiner* — George Nguyen
(74) *Attorney, Agent, or Firm* — Clifford W. Browning; Krieg DeVault LLP

(57) ABSTRACT

The component to be machined (2) is fixed with its axis in a position exactly determined in relation to the machine base (1) and the seat (3), by means of the sides (8) and the rear face (9) of the vee arranged on the seat and by means of the intermediate organ (11) in the form of a sector of ring, the concave cylindrical facets (23) of which are adapted to the component (2). The component (2) is pressed against the facets (23) by the finger (14) operated by the stirrup (15). The component (2) can be driven in rotation by a floating spindle operated by a servomotor into a position determined in relation to the machine seat (1).

5 Claims, 4 Drawing Sheets

PRECISION GUIDING DEVICE IN A MACHINE FOR MACHINING CYLINDRICAL COMPONENTS

This application claims the benefits under 35 U.S.C. 119 (a)-(d) or (b), or 365(b) of International Application No. PCT/IB2008/053471 filed 28 Aug. 2008, and 07115420.7 filed 31 Aug. 2007.

TECHNICAL FIELD

Machining of certain cylindrical tools made of hard materials, such as more or less long small diameter drills, must often fulfil extremely high demands for precision. Now, this is an area of the technology which is progressing towards a reduction in the numbers of components in the series, which raises the problem of a reduction in the unproductive times resulting from adaptation of the tooling to the changes of series. This adaptation must obviously be performed while guaranteeing the utmost quality of the positioning and guiding of the machined components at each modification of the guidance device.

BACKGROUND OF THE INVENTION

In conventional machines, the guidance device generally comprises a fixed part with two vee-shaped flat sides in which the component to be machined is engaged and guided and a mobile part, the support finger, which presses the component into the vee while ensuring rotation, the quality of which only depends at that point on the circularity of the component to be machined itself. During a change of series, the positioning vee must be changed, since the tool diameter of the new series differs from that of the preceding series and its positioning height must be adjusted with great precision in order to guarantee a perfect position of the rotation axis. This adjustment work for the position of the vee, according to a minimum of three degrees of freedom, is time consuming, thereby reducing the productivity of the whole machine. Finally, it reduces the versatility of the production system by only making it attractive for very long series.

SUMMARY OF THE INVENTION

The aim of the present invention is to eliminate this defect by creating a guidance device that retains the components in the machining machine with maximum precision for all the component diameters and which eliminates tedious adjustments during changes of series in order to minimise unproductive periods. Consequently, the device according to the invention makes it possible in particular to manage under competitive conditions processing of shorter series than up to now possible.

To this end the present invention concerns a precision guidance device in a machine for machining cylindrical components, characterised in that it comprises a support assembly defining a fixed axis for the said components and comprising a vee interdependent with a seat a set of interchangeable intermediate organs adapted to the vee and corresponding respectively to a specific diameter of a series of the said cylindrical components and a support finger pressing the component to be machined against the intermediate organ in the vee.

According to an embodiment of the device, in order to allow immediate changes of series, each interchangeable intermediate organ is in the shape of a sector of ring adjusted to the diameter of the components of a series of the components to be machined and externally arranged in order to be installed in the vee, between the latter and the cylindrical component to be machined, and each of the said intermediate organs may present, in a cylindrical concave surface corresponding to the diameter of the component, support facets precisely adjusted in order to receive the components of the series for which this organ is intended and a portion of convex cylindrical surface precisely coaxial to the said concave support facets and intended to rest against the sides of the vee.

According to a variant of the device, in each intermediate organ, the said portion of convex cylindrical surface is an external side forming the edge of a radial flange of the intermediate organ, the latter being fixed to the seat in the vee by an insert equipped with a hole for a securing screw to the seat and two holes for positioning pins of the insert, these pins being engaged in the seat outside the vee.

The support finger may be fixed in a stirrup pivoting on the seat, around an axis which is exactly perpendicular to that defined by the internal planes of the vee and be pressed against the component to be machined.

BRIEF DESCRIPTION OF THE DRAWINGS

An embodiment of the device according to the invention is described below, which is given as a mere example and is illustrated by the appended drawings, in which.

DETAILED DESCRIPTION OF EMBODIMENTS OF THE INVENTION

Figure 1:
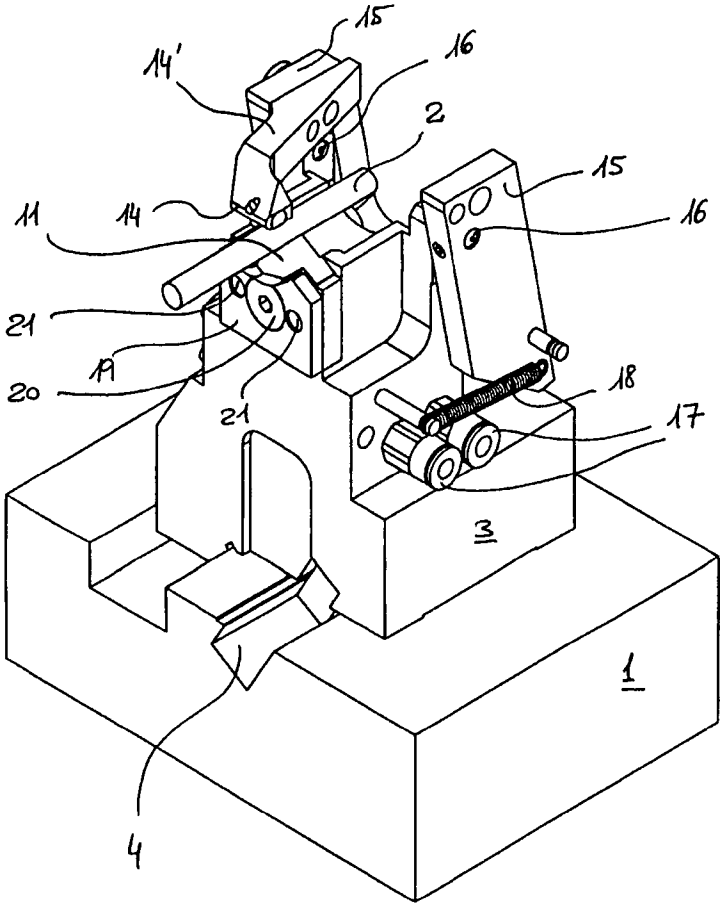
FIG. 1 is a perspective view of a support assembly with its seat, forming part of the guidance device.
Figure 2:
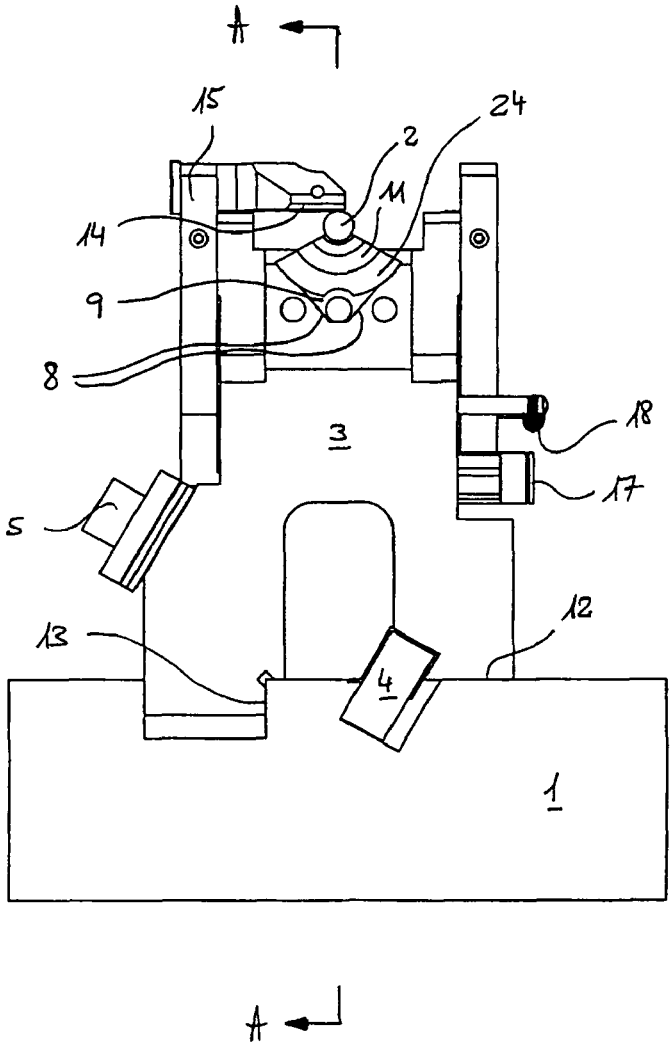
FIG. 2 is an elevated view of the face of the same assembly.

The guidance device represented in the drawing forms part of a machining machine for manufacturing cylindrical components such as drills made of hard material, the profile of which must be milled or rectified with utmost precision. It comprises a support assembly (FIGS. 1 and 2) mounted on a machine base 1. The support assembly in FIGS. 1 and 2 is arranged in order to maintain according to a strictly determined axis components 2 to be machined, i.e. drilling tools as mentioned above. It comprises a seat 3 fixed on the machine base 1 by a tightening strip 4 and a locking screw 5. For this purpose, the base 1 presents two flat surfaces 12 and 13 (FIG. 2), which are strictly even and perpendicular, against which two corresponding flat faces machined in the lower section of the seat 3 are applied. The seat 3 furthermore presents at its upper front part a machined housing with two oblique and symmetrical flat sides 8 (FIG. 2) and a vertical base which is also flat 9. These surfaces form a housing in a V-shape closed at the rear, in which an intermediate organ 11 to be described below is immobilised. The surfaces 8 are to be machined with great precision in relation to the faces 12 and 13 for positioning the seat 3 on the machine. They constitute the positioning reference of the tool 2 to be machined on the machine. With regard to the face 9, it serves as a support reference in the axial direction for the intermediate organ 11 and must therefore be flat and perfectly perpendicular to the axis defined by the vee 8.

Figure 3:
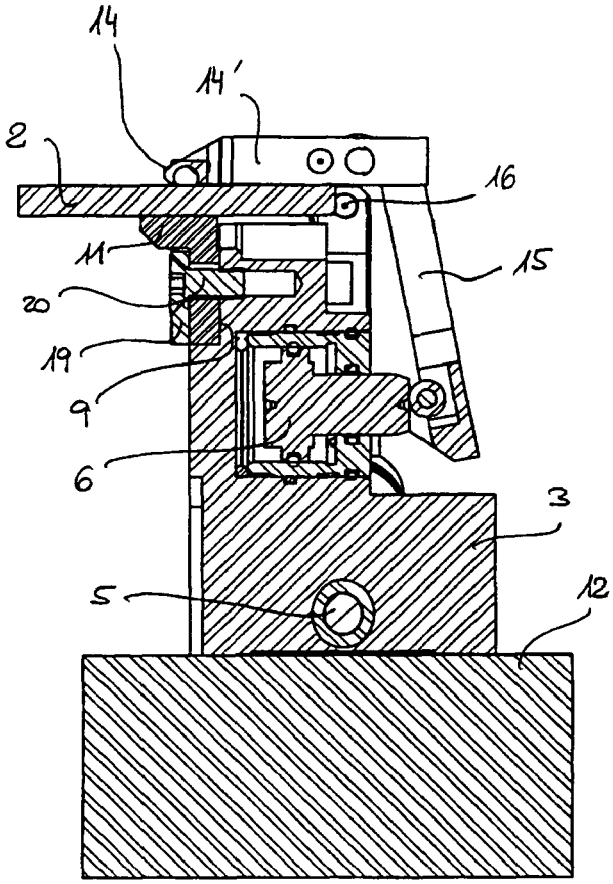
FIG. 3 is a vertical cross-section according to A-A of the assembly presented in FIG. 2

As can again be seen in FIGS. 1 to 3, the component 2 is supported in relation to the vee 8 and 9 by a finger 14 fixed, by means of an element 14', to a stirrup 15 pivoting around an axis 16 in relation to the seat 3. Use of a support finger 14 fixed on a stirrup 15 perpendicularly to the component to be machined is inherently known in conventional machines. It is known that such stirrups are often controlled hydraulically or pneumatically by a piston 6 housed in a chamber arranged in the seat and supplied by connections such as 17, in order to press the finger 14 against the component 2 against an escape spring 18.

In order to eliminate the fitting and adjustment operations at the time of a change of series of components to be machined, a set of interchangeable intermediate organs 11 (FIGS. 1, 2 and 4) is combined with the support assembly in FIGS. 1 and 2, each corresponding to a specific diameter of component to be machined. Consequently, in order to adapt the support assembly to a series of components to be machined of a given diameter, an organ 11 corresponding to this diameter is installed between the support finger 14 and the faces 8 and 9 of the vee. It is retained by a positioning insert 19 fixed to the seat by a screw 20 and two pins 21.

Figure 4:
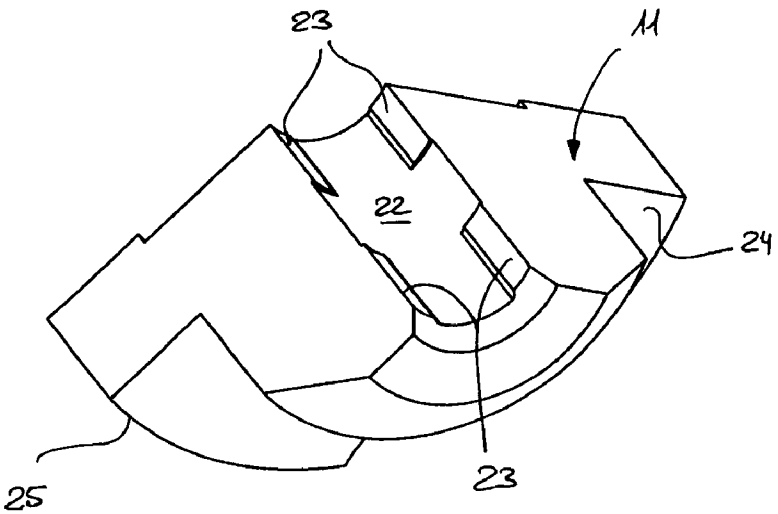
FIG. 4 is a perspective view of an intermediate organ forming part of the assembly in FIG. 1.

The intermediate organ 11, made of highly resistant material, is in the shape of a sector of cylindrical ring with a concave cylindrical arc-shaped hollow 22 determining the axis corresponding to the diameter of the component to be machined for which the organ is designed (FIG. 4). In order to ensure the best possible guidance, the surface 22 is bare and only four concave cylindrical facets 23 are maintained in symmetrical positions strictly contained in the same cylindrical surface. The organ 11 furthermore comprises a radial flange 24 limited by a portion of convex cylindrical surface 25 designed to rest against the faces 8 of the vee. Since the component 11 is a sector of ring, it may be produced with the greatest precision by interior and exterior cylindrical rectification operations. It is the diameter of the component 2 to be machined that determines the diameter of the surface 23 and therefore the choice of intermediate organ 11 and consequently the position of the common axis of the surfaces 23 and 25 in the vee 8, with this position being invariable.

It can be seen in FIG. 1 that the insert 19 is pressed by the screw 20 against the front face of the flange 24, which is consequently pressed against the face 9 of the housing forming the vee 8.

A change of series involves changing the component 11 held by the insert 19. The screw 20 locks the assembly and the pins 21 also serve to take up the friction torque in rotation during tightening of the screw 20, which would otherwise tend to cause the component 11 to rotate.

The support assembly described above therefore maintains the components to be machined in a position such that the axis of the component is strictly determined in relation to the seat and therefore in relation to the machine base 1. In order to allow machining of the components with the desired precision, the component must furthermore be driven in such a manner that it actually rotates around the axis defined by the support assembly. The machining machine will be provided with a workhead having a spindle in which the component to be machined will be fixed and by means of which it will be driven. If necessary, this workhead may be of a floating spindle type.

The skilled workman will readily understand that the vee 8 of the support assembly of the guidance device in the present invention, comprising two oblique and symmetrical flat sides, may of course be comprised of or replaced by a pair of curved, concave or convex surfaces and, for example, by two pins. Consequently, within the context of the present invention, the term "vee" denotes any pair of surfaces arranged in order to serve as a support according to two generatrices rectilinear to a cylindrical component, regardless of whether the said surfaces are flat or curved.

The invention claimed is:

1. Precision guidance device in a machine for machining cylindrical components, comprising support assembly defining a fixed axis for the said components and comprising a vee interdependent with a seat, a set of interchangeable intermediate organs adapted to the vee and corresponding respectively to a specific diameter of a series of the said cylindrical components and a support finger pressing the component to be machined against the intermediate organ in the vee.

2. Device according to claim 1, wherein in order to allow immediate changes of series, each interchangeable intermediate organ is in the shape of a sector of ring adjusted to the diameter of the components of a series of the components to be machined and externally arranged in order to be installed in the vee, between the latter and the cylindrical component to be machined.

3. Device according to claim 2, wherein each of the said intermediate organs presents, in a cylindrical concave surface corresponding to a diameter of the component, support facets precisely adjusted in order to receive the components of the series for which this organ is intended and a portion of convex cylindrical surface precisely coaxial to the said concave support facets and intended to rest against sides of the vee.

4. Device according to claim 2, wherein in each intermediate organ, the said portion of convex cylindrical surface is an external side forming an edge of a radial flange of the intermediate organ and wherein the latter is fixed to the seat in the vee by an insert equipped with a hole for a securing screw to the seat and two holes for positioning pins of the insert, these pins being engaged in the seat outside the vee.

5. Device according to claim 1, wherein the support finger is fixed in a stirrup pivoting on the seat, around an axis which is exactly perpendicular to that defined by the internal planes of the vee and is pressed against the component to be machined.

* * * * *